US005790919A

United States Patent [19]

Lee

[11] Patent Number: 5,790,919

[45] Date of Patent: Aug. 4, 1998

[54] METHOD FOR CONTROLLING TEMPERATURE OF HEATER OF IMAGE PROCESSING APPARATUS IN ACCORDANCE WITH CONSECUTIVE IMAGE FORMING OPERATIONS

[75] Inventor: Young-Seob Lee, Seoul, Rep. of Korea

[73] Assignee: SamSung Electronics Co., Ltd., Suwon, Rep. of Korea

[21] Appl. No.: 802,200

[22] Filed: Feb. 18, 1997

[30] Foreign Application Priority Data

Feb. 16, 1996 [KR] Rep. of Korea ..... 1996-3918

[51] Int. Cl.[6] ..... G03G 15/20

[52] U.S. Cl. ..... 399/43; 399/69; 399/70

[58] Field of Search ..... 399/69, 70, 43

[56] References Cited

U.S. PATENT DOCUMENTS

| | | | |
|---|---|---|---|
| 4,415,800 | 11/1983 | Dodge et al. . | |
| 4,425,494 | 1/1984 | Enomoto et al. . | |
| 4,825,242 | 4/1989 | Elter | 399/43 X |
| 4,878,092 | 10/1989 | Arai . | |
| 5,109,255 | 4/1992 | Nishikawa et al. . | |
| 5,241,349 | 8/1993 | Nagasaka . | |
| 5,331,384 | 7/1994 | Otsuka . | |
| 5,412,453 | 5/1995 | Matsuo . | |
| 5,481,346 | 1/1996 | Ohzeki et al. . | |
| 5,517,284 | 5/1996 | Ohtake et al. . | |
| 5,521,686 | 5/1996 | Muto . | |
| 5,534,987 | 7/1996 | Ohtsuka et al. . | |
| 5,555,075 | 9/1996 | Fukano . | |
| 5,563,696 | 10/1996 | Futagawa et al. . | |
| 5,572,306 | 11/1996 | Goto et al. . | |

*Primary Examiner*—Nestor R. Ramirez
*Attorney, Agent, or Firm*—Robert E. Bushnell, Esq.

[57] ABSTRACT

A method for controlling a temperature of a heating device in an image processing apparatus includes the steps of: setting the temperature of the heating device to a first temperature corresponding to a standby temperature upon activation of the image processing apparatus; increasing the temperature of the heating device to a second temperature corresponding to a fixing temperature upon activation of an image forming operation; increasing the temperature of the heating device to a third temperature higher than the second temperature upon consecutive activation of the image forming operation; and decreasing the temperature of the heating device back to the first temperature upon termination of the image forming operation.

8 Claims, 3 Drawing Sheets

METHOD FOR CONTROLLING TEMPERATURE OF HEATER OF IMAGE PROCESSING APPARATUS IN ACCORDANCE WITH CONSECUTIVE IMAGE FORMING OPERATIONS

CLAIM FOR PRIORITY

This application makes reference to, incorporates the same herein, and claims all benefits accruing under 35 U.S.C. §119 from an application for Method For Controlling Temperature Of Heater Of Image Processing Apparatus earlier filed in the Korean Industrial Property Office on the 16$^{th}$ day of Feb., 1996 and there duly assigned Ser. No. 3918/1996.

BACKGROUND OF THE INVENTION

1. Technical Field

The present invention relates to an image processing apparatus using an electrophotographic developing system, and more particularly to a method for controlling the temperature of a heater for generating heat required for fixing toner applied to a recording medium such as a sheet of paper.

2. Background Art

In an image forming apparatus such as a copier, a printer, an a facsimile machine etc., using an electrophotographic process, a latent image formed on a photosensitive drum is developed by applying toner from a developing unit onto the photosensitive drum. The toner image is then transferred and fixed on a recording medium. When a toner image is fixed on a recording medium, the toner image is first heated and fused onto the recording medium, and then naturally cooled so that it is fixed onto the recording medium.

In a conventional heat roller fixing device used for fixing an image on a recording medium, a pair of coactive fixing rollers consisted of one heat roller and one pressure roller is extensively used. The heat roller is typically heated to bring the pair of coactive rollers into contact with each other, thereby forming a nipping and fusing section. The recording medium is passed through this nipping and fusing section to fix the toner aligned thereon. When the recording medium is passed through the nipping and fusing section, the aligned toner which forms an image on the recording medium is heated and at the same time subjected to pressure. The heat energy and pressure applied at the nipping and fusing section changes the shape of the toner. This action causes the toner to be fixed onto the recording medium.

The heat roller is usually a hollow cylinder made of aluminum and has a heater at its central section. A halogen lamp is often used as the heater to maintain the heat roller at an initial low standby temperature when the apparatus is first turned on, or after printing is terminated, and to increase the heat roller to a high fixing temperature for fixing toner onto the recording medium when printing is initiated indicating that data is transmitted from a host computer. There is a variety of known fixing temperature control techniques that are available in the art to effectively control the setting of the temperature of the heat roller between an operable range and a standby range in order to save electric power. Such fixing temperature control techniques are disclosed, for example, in U.S. Pat. No. 5,572,306 for Image Forming Apparatus Capable Of Setting Fixing Temperature Corresponding To Temperature Rising State Of Heating Member issued to Goto et al., U.S. Pat. No. 5,563,696 for Image Fixing Apparatus With Power Control During Sheet Passage issued to Futagawa et al., U.S. Pat. No. 5,534,987 for Fixing Apparatus With Variable Fixing Temperature issued to Ohtsuka et al., U.S. Pat. No. 5,521,686 for Electrophotographic Image Forming Method And Apparatus Wherein Image Fixing Heater Temperature Is Controllable issued to Muto, U.S. Pat. No. 5,517,284 for Fixing Device issued to Ohtake et al., U.S. Pat. No. 5,481,346 for Image Forming Apparatus Capable Of Adjusting Fixing Conditions issued to Ohzeki et al., U.S. Pat. No. 5,412,453 for Temperature Controller issued to Matsuo, U.S. Pat. No. 5,241,349 for Image Forming Apparatus Having A Plurality Of Control Modes Of Thermal Fixing Apparatus issued to Nagasaka, U.S. Pat. No. 5,109,255 for Temperature Control System issued to Nishikawa et al., and U.S. Pat. No. 4,415,800 for Method And Apparatus For Monitoring And Controlling Heated Fusers For Copiers issued to Dodge et al.

When the fixing device is operated in a continuous print mode, however, heat is absorbed by the pressure roller and recording media which are sequentially fed into the unit. As a result, the fixing is temperature on the surface of the heat roller is lowered, and the fixing quality of an image is deteriorated. Traditional efforts in the art to cope with a temperature drop of the heat roller temperature beyond the secure fixing temperature are to interrupt the image forming operation or to reduce the printing rate which, in turn, reduces the heat which is absorbed by recording media to restore the heat roller temperature to the secure fixing level.

Recent efforts in the art to compensate for the heat loss to the recording medium and pressure roller are disclosed, for example, in U.S. Pat. No. 5,555,075 for Fixation Temperature Control Device issued to Fukano et al., U.S. Pat. No. 5,331,384 for Fixing Apparatus Having Temperature Controller Which Controls Temperature According To Width Size And Number Of Recording Sheets issued to Otsuka, U.S. Pat. No. 4,878,092 for Method Of Controlling A Fixing Unit Of An Image Forming Apparatus issued to Arai, and U.S. Pat. No. 4,425,494 for Heat Roller Fixing Unit issued to Enomoto et al. In Fukano '075, for example, the temperature of a heat roller is constantly maintained at a fixing temperature. When the heat roller temperature is lower than a fixing temperature, a correction value as determined from the detected temperature of the press roller is added to the heat roller temperature to set the heat roller control temperature higher than usual. While the heat loss to the recording medium and the like is compensated in all image forming operations, the fixation temperature control device of Fukano '384 is cost prohibitive because of sophisticated temperature sensor circuitry. Similarly, Otsuka '384 requires constant adjustment and readjustment of the heat roller temperature so as to compensate for the heat loss to recording medium and maintain the fixing temperature at a constant level. In Arai '092, the secure fixing temperature of a heat roller is changed to at least two different fixing temperatures depending upon the expiration of a predetermined time period and the number of copies made after the turn-on of the power supply. In Enomoto '494, the fixing temperature of the heat roller is maintained at a constant level by temporarily raising the temperature of the heated roller only during each image forming operation to compensate for the heat loss to the recording medium and pressure roller. While the efforts allow minimum interruption of image forming operations, it has been my observation that the fixing temperature of the heat roller is not efficiently compensated in case when a single sheet of printable medium is printed and in case when successive sheets of printable medium are continuously printed. Accordingly, further improvements can be made.

SUMMARY OF THE INVENTION

It is therefore an object of the present invention to provide an improved fixing temperature control unit that is simple and cost effective in operation.

It is also an object to provide a fixing temperature control unit and method for controlling the fixing temperature of a heat roller so as to compensate for a temperature drop due to the heat loss to the recording medium in order to improve the fixing quality of an image.

These and other objects of the present invention can be achieved by a fixing temperature control unit and a process of controlling a temperature of a heating device in an image processing apparatus by setting the temperature of the heating device to a first temperature corresponding to a standby temperature upon activation of the image processing apparatus; increasing the temperature of the heating device to a second temperature corresponding to a fixing temperature upon activation of an image forming operation; increasing the temperature of the heating device to a third temperature higher than the second temperature upon consecutive activation of the image forming operation; and decreasing the temperature of the heating device back to the first temperature upon termination of the image forming operation.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
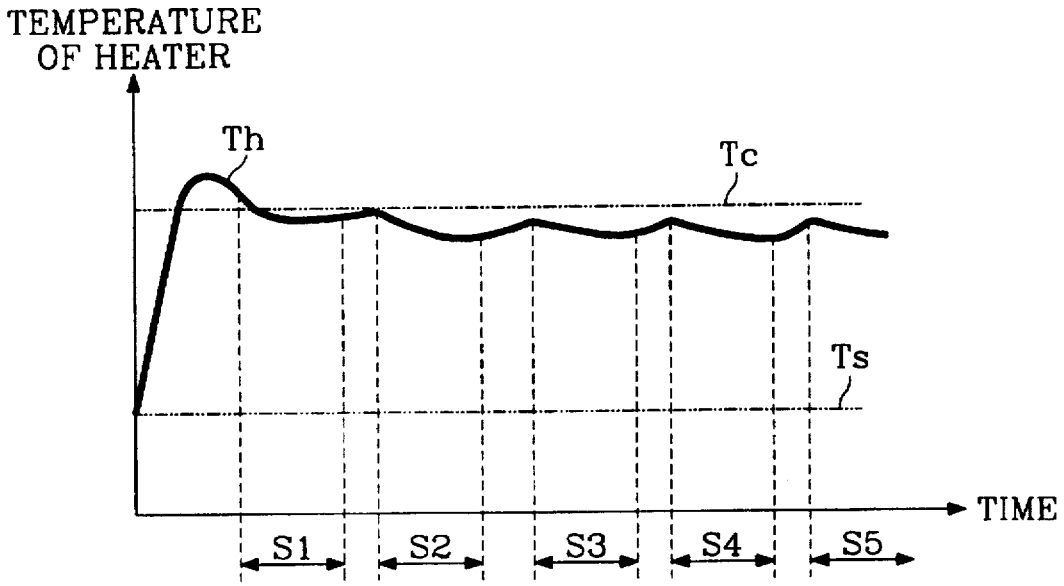
FIG. 1 is a timing chart showing changes in the temperature of the surface of a typical heat roller, when a single sheet of printable medium is printed and when successive sheets of printable medium are continuously printed.

Referring now to the drawings and particularly to FIG. 1, which is a timing chart showing changes in the temperature of the surface of a heat roller of a typical fixing device when a single sheet of printable medium is printed and when successive sheets of printable medium are continuously printed. As shown in FIG. 1, Ts represents a standby temperature of the heater during a standby mode, and to represents a print control temperature, i.e., fixing temperature for fixing an unfixed image on a recording medium during an image forming operation, i.e., printing operation. S1–S5 represent respective printing intervals of the recording medium corresponding to the printing pages during continuous printing. FIG. 1 illustrates an example of the continuous printing of five (5) successive pages, wherein S1, S2, S3, S4 and S5 represent the continuous printing intervals of 1st, 2nd, 3rd, 4th and 5th pages respectively.

When the image forming apparatus begins a print operation from a standby state, the actual heater temperature This increased from the standby temperature Ts to the print control temperature Tc. Thereafter, the heater temperature This increased to the print control temperature Tc for fixing an unfixed image on a recording medium by switching the heater to turn "on" or "off" according to is the basis of the print control temperature Tc. After completion of all print operations, the heater temperature Th is decreased and maintained at the standby temperature Ts. This sequence is performed not only in the case of continuous printing operations of many pages but also in the case of a single page printing operation. When the image forming apparatus is operated in a continuous printing mode as shown in FIG. 1, the heater temperature Th is continuously converged at the print control temperature Tc by switching the heater to "on" or "off" according to the basis of the print v control temperature Tc until the printing of all pages is completed.

When the fixing device is operated in the same continuous print mode, however, heat is absorbed by the pressure roller and recording media which are sequentially fed into the unit. In case of single page printing, the heater temperature Th is typically overshot beyond the print control temperature Tc when the heater is initially heated from the standby temperature Ts to the print control temperature Tc. This overshoot can often compensate for the temperature drop of the heat roller due to the heat absorption of the first recording medium. Consequently, there is usually no problem for the heat roller to fix an unfixed image on the first recording medium. In case of continuous page printing, however, since the recording medium passes continuously along the heat roller, the recording medium absorbs the heat repeatedly from the heater. As a result, the actual printing temperature of the heat roller which is initially set at the print control temperature Tc is now lower than the print control temperature Tc required for fixing an unfixed image on the recording medium as shown in each of S2–S5 intervals of FIG. 1. When the heat roller is not heated at the proper print control temperature Tc for fixing an unfixed image on the recording medium, the fixing quality of an image will deteriorate.

Figure 2:
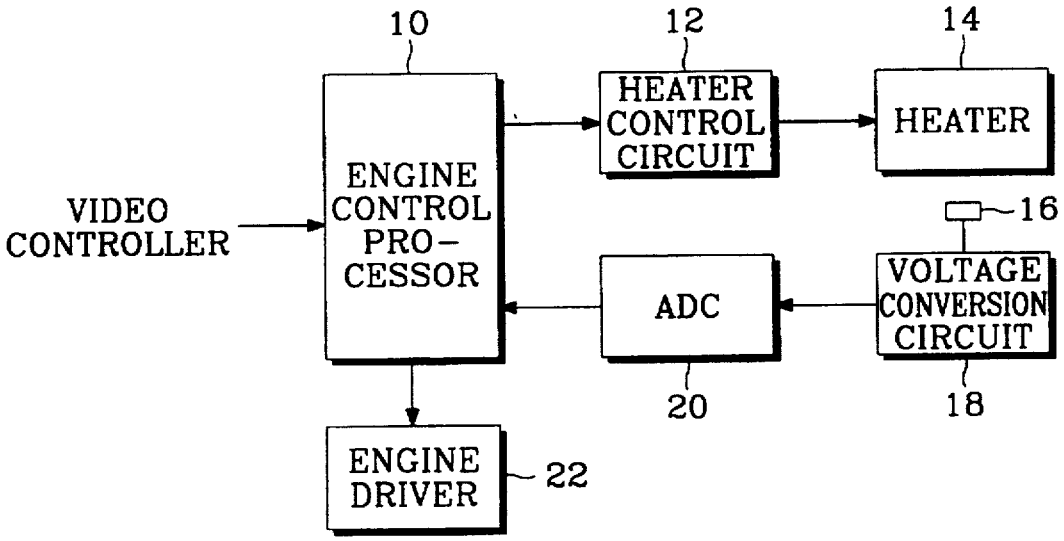
FIG. 2 illustrates a print engine unit having a heater control circuit incorporated in an image forming apparatus constructed according to the principles of the present invention.

Referring now to FIG. 2 which illustrates a print engine unit having a heater control circuit incorporated in an image forming apparatus such as a laser beam printer (LBP) constructed according to the principles of the present. The LBP consists generally of the video controller and the print engine unit. The video controller processes video data received from a host computer and transmits the processed video data to the print engine unit. The print engine unit then prints the image based on the video data received from the video controller onto a recording medium.

As shown in FIG. 2, the print engine unit includes an engine control processor 10 for 8 controlling operation of the print engine unit, a heater control circuit 12 for controlling operation of a heater 14, a thermistor 16 serving as a temperature sensor, a voltage conversion circuit 18, an analog-to-digital converter ADC 20 and an engine driver 22. The engine control processor 10 controls the heater 14 to turn "on" or "off" through the heater control circuit 12 so as to control the temperature of the heater 14 contained in the heat roller. For example, upon receipt of an "on" signal from the engine control processor 10, the heater control circuit 12 applies power to the heater 14 to increase the temperature of the heater 14. Likewise, upon receipt of an "off" signal from the engine control processor 10, the heater control circuit 12 cuts off the power supply to the heater 14, that is, to turn the heater 14 "off" so as to decrease the temperature of the heater 14.

At this time, the heater 14 is provided with a thermistor 16 having negative resistance characteristics as a temperature sensor. The resistance value of the thermistor 16 varies according to the temperature of the heater 14, and the voltage conversion circuit 18 is coupled to the thermistor 16 to generate an output signal having a voltage level corresponding to the resistance value of the thermistor 16 to apply to the ADC 20. Upon receipt of the output signal having a voltage level corresponding to the resistance value of the thermistor 16 from the voltage conversion circuit 18, the ADC 20 converts the received signal into digital data to apply to the engine control processor 10. The engine control processor 10 then detects the current temperature of the heater 14 from the output digital data of the ADC 20 and according thereto, controls the heater 14 through the heater control circuit 12 so that the temperature of the heater 14 corresponds to an object temperature. At this time, if the temperature of the heater 14 is higher than the object temperature, the engine control processor 10 decreases the temperature of the heater 14 by switching the power to "off", and if the temperature of the heater 14 is lower than the object temperature, increases the temperature of the heater 14 by switching the power to "on", thereby maintaining the temperature of the heater 14 at a uniform temperature level.

Figure 3:
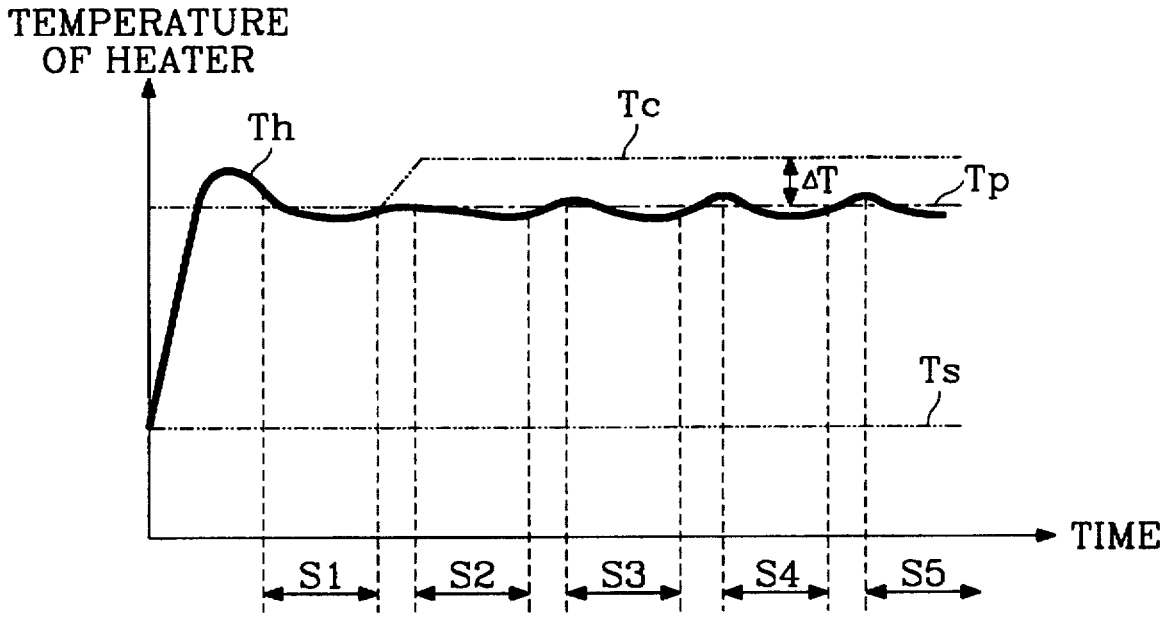
FIG. 3 is a timing chart showing temperature compensation of the surface of a heat roller when successive sheets of printable medium are continuously printed according to the present invention.

The present invention provides an image processing apparatus having a novel print engine unit in which the heater temperature of a heat roller is increased by ΔT as shown in FIG. 3 in order to compensate the temperature drop of the heater 14 when printing continuously, and to thereby maintain the heater temperature of the heat roller at a print control temperature Tc. FIG. 3 is a timing chart showing temperature compensation of the surface temperature of the heat roller when successive sheets of printable medium are continuously printed, for example, five successive pages according to the present invention. The reference letters Ts, Tc, Th and SI–S5 as shown in FIG. 3 are respectively the same as that shown in FIG. 1. In addition, Tp represents the actual printing temperature of the heat roller specified for the corresponding image processing apparatus, and the print control temperature Tc is the same print control temperature as shown in FIG. 1. However, the present invention is characterized in that the printing temperature Tp of the heat roller is increased to the print control temperature Tc by controlling the heater 14 so as to compensate for the temperature drop of the heater 14 when printing continuously.

For example, after the printing of the first page, the actual temperature of the heater 14 which is initially set at the print control temperature Tc slowly drops below the print control temperature Tc required for fixing an unfixed image onto a recording medium due to the heat absorption of the recording medium as shown in FIG. 1. In order to compensate for this temperature drop of the heater 14 due to the heat absorption of the recording medium, a compensation temperature ΔT is added to the actual temperature of the heater 14 so as to converge at the printing temperature Tp. The value of the compensation temperature ΔT is determined based upon actual experiments, and for example, the temperature drop of the heater 14 when applied to the LBP is 10° C.–15° C. In above case, when the initial print control temperature Tc is increased by ΔT of, for example, 10° C., the actual temperature of the heater 14 is now converged at the printing temperature Tp to some degrees. At this time, it is desirable that the time for increasing the print control temperature Tc is set immediately after finishing of 1st page printing. The reason is that since the heater temperature Th becomes higher is than the print control temperature Tc due to the overshooting during the first page printing, there exists no problem for the fixing process.

Figure 4:
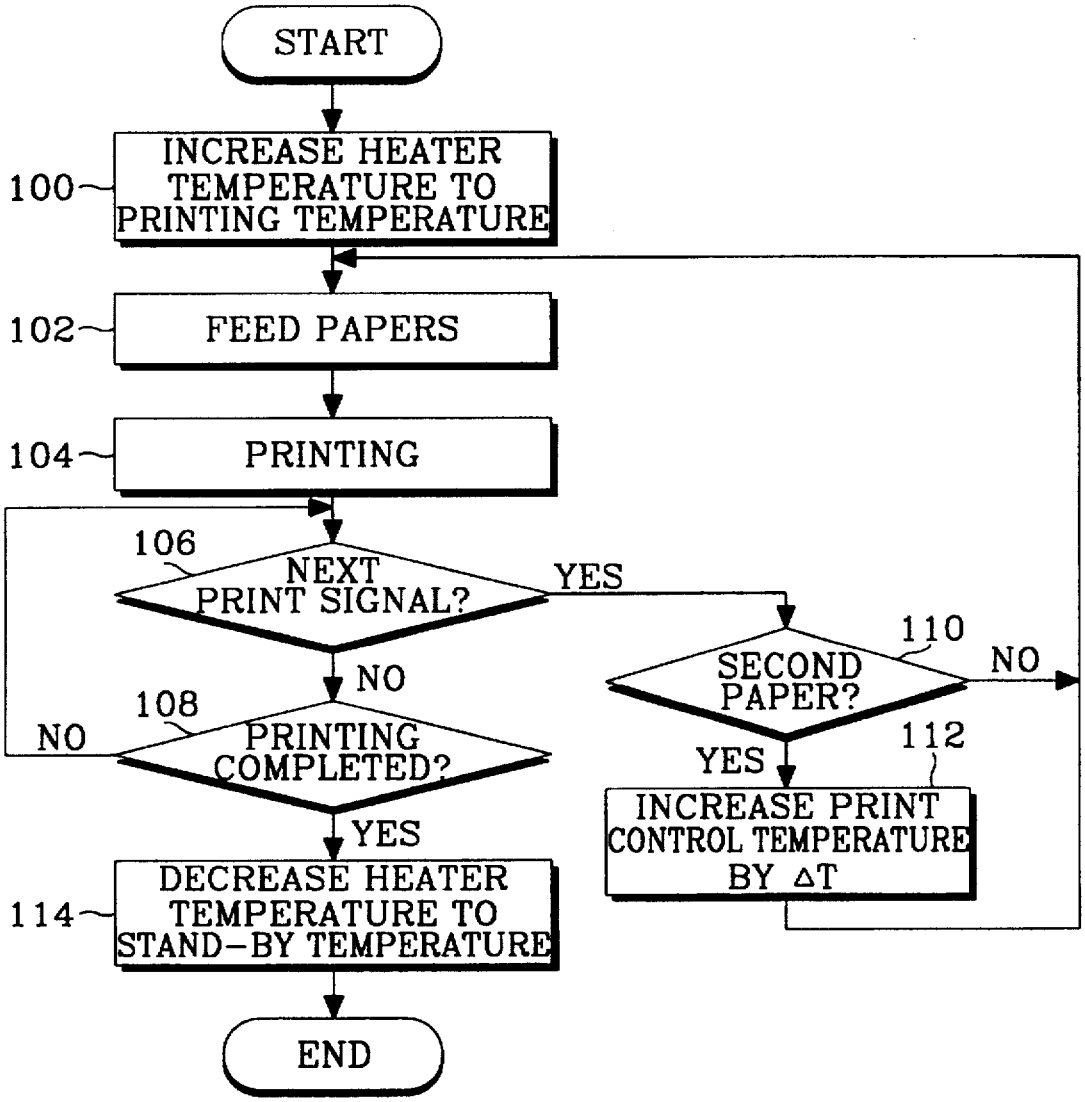
FIG. 4 is a flow chart showing a process of controlling the heater temperature compensation of the surface of a heat roller when successive sheets of printable medium are continuously printed according to the present invention.

FIG. 4 illustrates a process of controlling the heater temperature compensation of the surface of the heat roller when successive sheets of printable medium are continuously printed according to the present invention. Upon receipt of a print signal from the video controller, the engine control processor 10 controls the heater 14 through the heater control circuit 12 at step 100 so as to increase the heater temperature Th from a standby temperature Ts to a printing temperature Tp. Thereafter in steps 102–104, the engine control processor 10 starts the engine driver 22 as usual to thereby supply papers and proceed with the printing. At this time, the engine control processor 10 detects a next print signal incoming from the video controller before finishing the current printing at steps 106–108. If the next print signal is not detected until the printing of one (1) page is finished, which is recognized as a single printing operation at step 114, the engine control processor 10 decreases the temperature of the heater 14 back down to the standby temperature Ts in order to complete the printing operation.

On the contrary, if the next print signal is detected before finishing the printing of one page, which is recognized as a continuous printing operation, the engine control processor 10 proceeds to step 110. In step 110, the engine control processor 110 ascertains whether the next print signal is for a second page. If the next print signal is ascertained for the second page, the engine control processor 10 increases the print control temperature Tc by ΔT at step 112 as shown in FIG. 3 and proceeds to step 102 in order to proceed with the printing of the next page. Thereafter in case of continuous printing, the engine control processor 10 controls the heater 14 so that the actual temperature of the heater 14 is converged at the increased print control temperature Tc from the second page forth. Therefore in case of continuous printing, even if the temperature of the heater 14 drops due to the heat absorption of the recording medium, the actual heater temperature Th is converged at the printing temperature Tp. If the next page is not identified as a second page in step 110, the engine control processor 10 proceeds immediately to step 102 for printing the next page because the print control temperature Tc is already in the increased temperature state.

Even in case of continuous printing, the temperature drop of the heater 14 due to the heat absorption of the recording medium can be compensated by controlling the temperature of the heater 14, and the actual heater temperature Th is converged at the specified printing temperature Tp, so that the fixing process for the continuous printing operation can be normally performed as in the single printing operation. As a result, the fixing temperature control unit of the present invention advantageously enhances the fixing quality of an image by compensating for the temperature drop of the heater 14 due to the heat absorption of the recording medium so as to maintain the actual temperature of the heater 14 at the specified printing temperature when successive sheets of printable medium are continuously printed While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiment disclosed as the best mode contemplated for carrying out the present invention, but that the present invention includes all embodiments falling within the scope of the appended claims.

What is claimed is:

1. A method for controlling a temperature of a heating device in an image processing apparatus, comprising the steps of:

setting the temperature of the heating device to a first temperature corresponding to a standby temperature upon activation of said image processing apparatus;

increasing the temperature of the heating device to a second temperature corresponding to a fixing temperature upon activation of an image forming operation for forming an image on a recording medium;

increasing the temperature of the heating device to a third temperature higher than said second temperature after each image forming operation only upon consecutive activation of said image forming operation for forming images on successive recording media; and decreasing the temperature of the heating device back to said first temperature upon termination of said image forming operation.

2. The method of claim 1, further comprised of said heating device being heated to said third temperature to compensate for temperature drop of said heating device after each image forming operation due to heat loss to the recording medium.

3. A method for controlling a temperature of a heating device in an image processing apparatus, comprising the steps of:

increasing the temperature of said heating device to a specified printing temperature at the start of printing;

determining whether a printing operation is continuously performed while the printing is performed at said specified printing temperature;

increasing a print control temperature as a control basis for said heating device higher than said specified printing temperature after printing a first page when the printing operation is continuously performed;

controlling the temperature of said heating device to maintain at said print control temperature; and decreasing the temperature of said heating device back to a standby temperature after completing the continuous printing operation.

4. The method of claim 3, further comprised of the increased value of said print control temperature being set to compensate for a temperature drop of said heating device after each printing operation due to the heat loss to said recording medium.

5. An image forming apparatus, comprising:

a fixing unit having a pressure roller and a heat roller heated by a heater for thermally fixing a visible image on an individual sheet of recording medium passing between the pressure roller and the heat roller, upon activation of an image forming operation; and control means operatively connected to said fixing unit, for energizing the heater to increase a surface temperature of the heat roller initially to a first temperature upon activation of said image processing apparatus, to increase the surface temperature of the heat roller to a second temperature upon activation of said image forming operation, and to increase the surface temperature of the heat roller by a third temperature after each image forming operation only upon consecutive activation of said image forming operation, and for deenergizing the heater to decrease the surface temperature of the heat roller back to said first temperature upon termination of said image forming operation.

6. The image forming apparatus of claim 5, further comprised of said first temperature corresponding to a standby temperature, said second temperature corresponding to a fixing temperature for fixing said visible image onto said recording medium, and said third temperature corresponding to a temperature increase to the surface of the heat roller to maintain the surface of the heat roller at said second temperature to compensate for temperature drop on the surface of the heat roller after each image forming operation due to heat loss to the recording medium, when consecutive image forming operation is activated.

7. The image forming apparatus of claim 6, further comprised of said third temperature corresponding to a temperature value of approximately 10°–15° C. to maintain the surface of the heat roller at the fixing temperature for fixing said visible image onto said recording medium when consecutive image forming operation is activated.

8. The image forming apparatus of claim 5, further comprised said heat roller being heated to said third temperature to compensate for temperature drop in the surface of the heat roller after each image forming operation due to heat loss to the recording medium, when consecutive image forming operation is activated.

* * * * *